US005704706A

United States Patent [19]

Goldston et al.

[11] Patent Number: 5,704,706

[45] Date of Patent: *Jan. 6, 1998

[54] PLUG-IN LIGHT MODULE

[75] Inventors: Mark R. Goldston, Los Angeles, Calif.; Jon L. Bemis, Middleboro, Mass.; Carmen Charles Rapisarda, Monrovia, Calif.

[73] Assignee: L.A. Gear, Inc., Santa Monica, Calif.

[ * ] Notice: The term of this patent shall not extend beyond the expiration date of Pat. No. 5,285,586.

[21] Appl. No.: 461,104

[22] Filed: Jun. 5, 1995

Related U.S. Application Data

[60] Continuation of Ser. No. 140,239, Oct. 20, 1993, abandoned, which is a division of Ser. No. 917,000, Jun. 26, 1992, Pat. No. 5,285,586.

[51] Int. Cl.[6] ..... F21L 15/08

[52] U.S. Cl. ..... 362/103; 362/200; 362/201

[58] Field of Search ..... 362/196, 103, 362/189, 200, 201, 253, 800, 106, 191; 36/137

[56] References Cited

U.S. PATENT DOCUMENTS

| | | | |
|---|---|---|---|
| 3,359,411 | 12/1967 | Schwartz | 362/189 |
| 3,800,133 | 3/1974 | Duval | 362/103 |
| 4,014,115 | 3/1977 | Reichert | 36/137 |
| 4,336,574 | 6/1982 | Goodman | 362/200 |
| 5,052,131 | 10/1991 | Rondini | 362/103 |
| 5,158,356 | 10/1992 | Gurthrie | 362/200 |
| 5,235,761 | 8/1993 | Chang | 36/137 |

FOREIGN PATENT DOCUMENTS

| | | | |
|---|---|---|---|
| 3824352 | 2/1990 | Germany | 36/136 |
| 1058466 | 2/1967 | United Kingdom | 362/200 |

*Primary Examiner*—Y. My Quach

*Attorney, Agent, or Firm*—Don C. Lawrence, Esq.

[57] ABSTRACT

An athletic shoe (20) includes a sole (22), an upper (25), and a tongue (26), as well as fasteners (28), such as shoelaces. Incorporated into the sole (22) of the athletic shoe (20) is a receptacle (30) for receiving and retaining a plug-in module (32) in a slide-in, releasably locking arrangement. The plug-in module (32) preferably includes a battery (62), a light emitting device (54), and electrical circuit elements (58, 60, 72) arranged to selectively connect the battery (62) to the light emitting device (54).

19 Claims, 5 Drawing Sheets

PLUG-IN LIGHT MODULE

This is a continuation of application Ser. No. 08/140,239, filed Oct. 20, 1993, now abandoned, which is a divisional of application Ser. No. 07/917,000, filed on Jun. 26, 1992, now U.S. Pat. No. 5,285,586.

BACKGROUND OF THE INVENTION

The present invention relates to an athletic shoe having a novel feature directed to enhancing its safety and practical utility. More specifically, the athletic shoe of the present invention incorporates a releasably locking, plug-in module that is removably insertable into a recessed retaining receptacle in the sole of the shoe. The plug-in module may include a battery and an externally visible light emitting device interconnected via circuitry that includes a switch for energizing the light emitting device in response to pressure exerted upon it by the foot of the wearer during walking or running.

There are a number of references in the patent literature that depict various methods for incorporating light emitting elements and batteries to energize them into various portions of a shoe in order, e.g., to provide a visually distinctive shoe. In a majority of the examples found in the prior art, the light emitting device, as well as the batteries, have been incorporated into the heel portion of the sole of a dress shoe. The advantage of this configuration is that the heel of a dress shoe generally provides sufficient volume to easily accommodate the electronic apparatus, and is constructed of a rugged, non-resilient material that protects the light and battery and, in a translucent version, can also serve as a light conductor or spreader.

For example, U.S. Pat. No. 4,253,253, British Patent No. 444,392, and Belgian Patent No. 570614, all illustrate womens high heel dress shoes incorporating a battery in the hollow interior of the heel of the shoe. Alternatively, U.S. Pat. Nos. 1,597,823, 2,931,893, 4,014,115, and 5,052,131, as well as European Patent publication No. EP-121-026-A, depict lighted dress and casual shoes incorporating a raised or block-type of heel having a recessed inner portion for receiving the battery.

There may be several reasons for incorporating an active light emitting device into a shoe, e.g., to enhance the night safety of the wearer, to provide special visual effects at entertainment events, or to assist in certain biomechanical testing and measurements.

Thus, while it is known to incorporate passive reflectors, including reflective tapes and the like, on the equipment or apparel of athletes, such as joggers or bicyclers to increase their visibility, and hence, safety, at night, it is necessary for the purely reflective elements to be illuminated by an external, active light source, such as the beam of an automobile headlight, in order for them to function. Footwear that incorporates its own built-in, active light source, and which, therefore, does not depend on an external source for illumination, can provide a higher level of visibility and safety than those that are purely reflective in nature.

Further, the incorporation of active light sources into the shoes of participants engaged in certain entertainment events, such as those worn by dancers, marching bands, athletes and the like, can achieve special, entertaining visual effects in low light conditions, particularly where it is desired to call attention to the participants' feet. For example, a marching band equipped with such footwear can present an impressive spectacle, as the individually-illuminated feet of its members move in synchronous unison.

The provision of an active light source on the shoes worn by test subjects engaged in certain walking and running motion studies can also enhance the ability of scientists and biomechanical engineers to measure and analyze those activities from a human engineering or sports medicine standpoint. Such studies frequently involve photographing a particular point or reflective target disposed on the foot or ankle of a test subject with high-speed motion picture equipment, then digitizing the motion of that point under examination can enhance the testing procedure because the active light source is photographically more distinct, and hence, easier to photograph. Additionally, the light source can be adapted with a pressure- or acceleration-sensitive switch to illuminate selectively when a certain pre-set force or acceleration is exerted upon it during a particular activity. Thereby, the forces or accelerations acting on the shoe during various athletic endeavors can be better analyzed.

A review of the references in the prior art reveals that the incorporation of a light-emitting device into the sole of an athletic shoe is complicated by the specific qualities of resiliency, flexibility, and support required of such a shoe's sole during athletic activities. An improperly designed athletic shoe sole that does not provide the desired degree of support, protection, and comfort for the athlete is unacceptable. Thus, it is not a simple matter of taking the teachings of the prior art, directed to various types of dress and casual shoes having block or high heels and essentially rigid soles, and incorporating the designs for their lighting device and power sources in generally the same configuration into an athletic shoe.

A further limitation of the designs of the prior art, to the extent that they can be incorporated into athletic shoes, relates to their relative inaccessibility within the shoe, with a concomittant lack of replaceability and maintainability of their various components, including their batteries, light sources, and switching components.

SUMMARY OF THE INVENTION

This invention discloses an article of athletic footwear of relatively conventional construction, but which incorporates into its sole a receptacle that is configured to receive a removable, plug-in module in slide-in, releasably locking engagement. The module preferably includes a replaceable power source, e.g., a battery, electrical circuitry that includes a switch, for example, a pressure sensitive switch that is operatively responsive to a force exerted on it by the wearer's foot, and a light-emitting device, such as a light emitting diode ("LED"). The plug-in module is configured to be inserted into the receptacle in slide-in fashion, and positively, although removable, retained therein. By this configuration, the plug-in module can be easily removed from the athletic shoe, to allow, for example, replacement of the battery, or to allow replacement of the entire plug-in module with another module having, for example, a different light source, power supply, mode of operation, or even an altogether different function.

DETAILED DESCRIPTION OF THE PREFERRED EMBODIMENT

Figure 1:
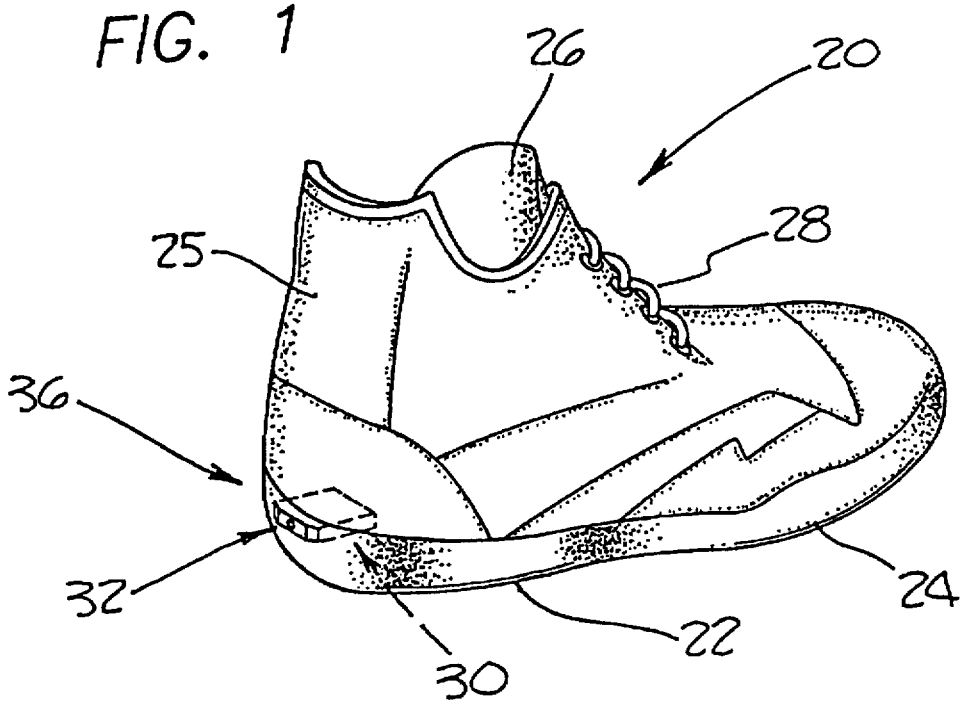
FIG. 1 is a schematic illustration of an athletic shoe according to the present invention, including a plug-in light module assembly.

FIG. 1 illustrates an athletic shoe 20 according to the present invention. The shoe 20 typically includes a resilient sole 22, which may itself further comprise a midsole portion 23 and an outsole portion 24 underlying it, as well as an upper 25, a tongue 26, and fastener means 28, such as the laces illustrated, for securing the shoe to the wearer's foot.

Figure 2:
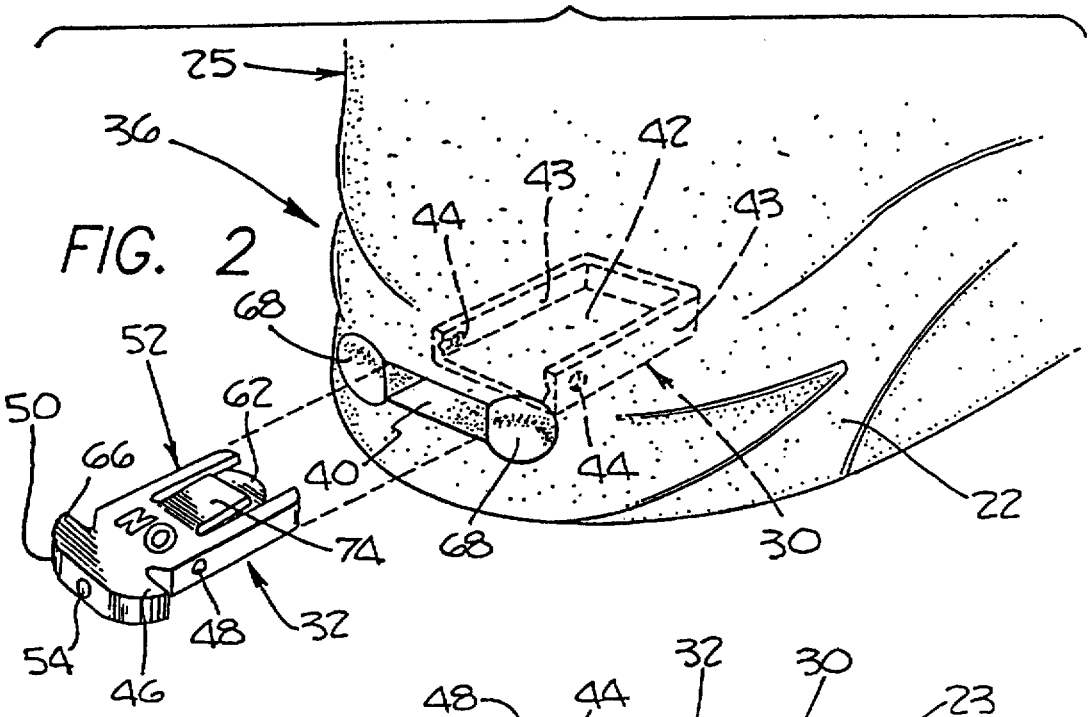
FIG. 2 is an exploded partial view of the athletic shoe according to FIG. 1, illustrating the plug-in light module assembly removed from the retaining slot.
Figure 3:
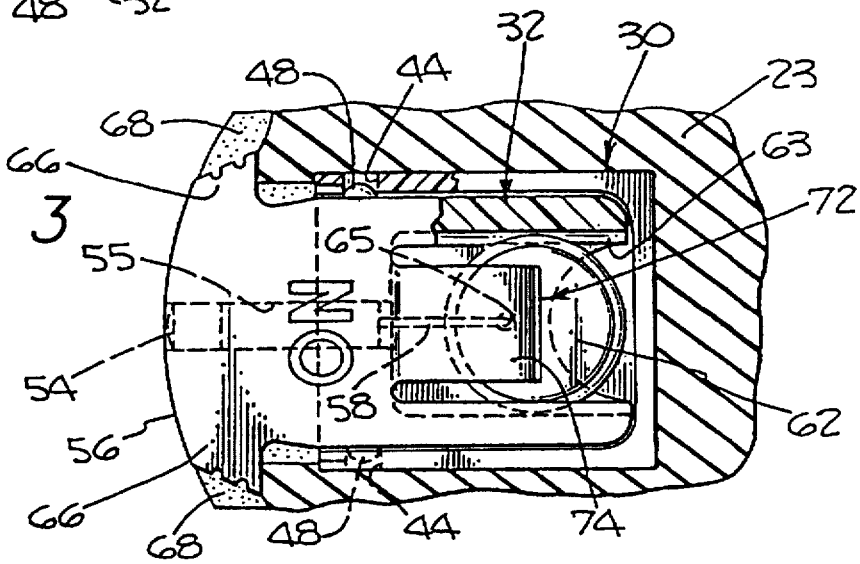
FIG. 3 is a top view of the plug-in module observed at a cross-section through the sole of the shoe.

As illustrated in greater detail in FIGS. 2 and 3, incorporated into the sole 22 of the athletic shoe 20 are receptacle means 30 for receiving and retaining a plug-in module 32 in a slide-in, releasably locking configuration. The receptacle means 30 are preferably disposed in the heel portion 36 of the sole 22, where the sole is typically the thickest, and comprise an opening 40 into, and an internal chamber 42 within, the midsole portion 23 of the sole of the shoe, for allowing insertion, retention, and removal of the plug-in module 32.

As may be appreciated from FIG. 2, the receptacle means 30 also preferably include a more rigid, rectangular tray structure that is molded or bonded into the midsole portion 23 of the sole 22 of the shoe. The internal faces of the side walls 43 defining the tray structure of the receptacle means 30 include a pair of depressions 44, the operative function of which is described below.

The plug-in module 32 includes a structure that can be likened to a small cabinet drawer. The plug-in module 32 includes a housing or body 46 having an outer face 50 and a generally rectangular body portion 52 that is configured to be slidably inserted into the interior of the receptacle means 30. Affixed to, or formed as a part of, the lateral side walls of the rectangular portion is a pair of protrusions 48. These protrusions 48 are configured to engage the depressions 44 in the walls 43 of the receptacle means 30 in a resilient, camming, over-center, locking engagement upon complete insertion of the plug-in module 32 into the receptacle means 30, thereby releasably locking and retaining the plug-in module 32 therein. This releasable locking arrangement prevents inadvertent ejection of the plug-in module 30 from the shoe during vibration, fexture or shock of the shoe, but can be overcome by the user in the manner described below.

The plug-in module 32 is also preferably configured to include a pair of tabs 66 at the edges of the outer face 50. The tabs 66 are formed to fit smoothly within a pair of scallops or contoured recesses 68 formed into the outer surface of the sole 22 immediately adjacent the sides of the opening 40, without exposing any sharp corners. By this co-operative relationship, the scalloped-shaped recesses 68 permit the wearer of the shoe 20 conveniently to grasp the tabs 66 of the plug-in module 32 with his or her fingertips and, by pulling forcefully outward on it, overcome the resilient locking engagement of the module side protrusions 48 within their mating receptacle depressions 44, thereby permitting extraction of the plug-in module 32 from the receptacle means 30.

Figure 4:
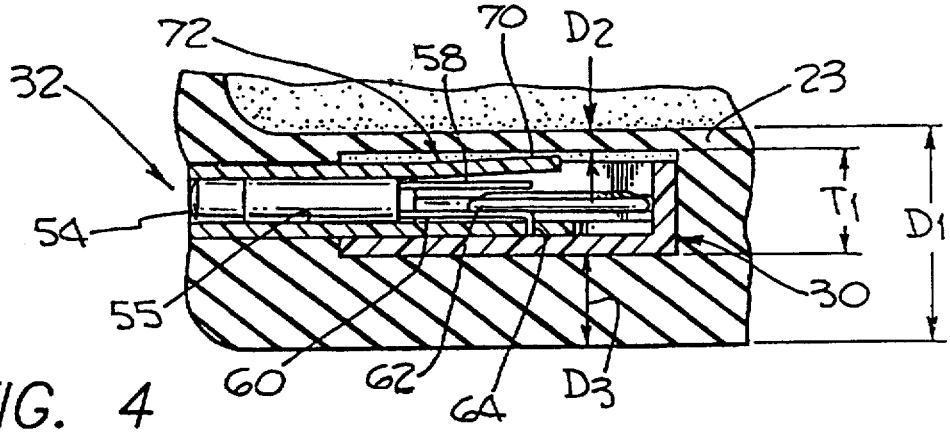
FIG. 4 is a cross-sectional view through the plug-in module.
Figure 5:
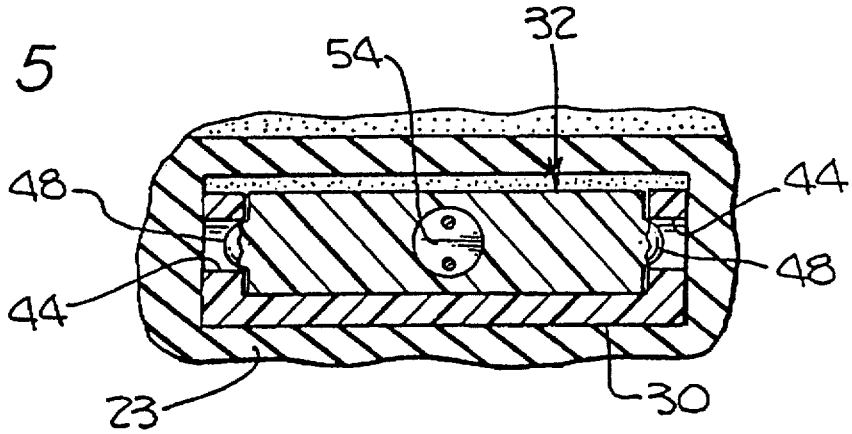
FIG. 5 is a cross-sectional view of the plug-in module.

In the embodiment illustrated in FIGS. 2–7, the plug-in module 32 preferably includes a light-emitting device, such as a light bulb or a light-emitting diode ("LED") 54 molded, bonded, or otherwise fixed into a bore or aperture 55 that extends through the outer face 50 and into the body 46 of the module 32, such that the bulb or LED 54 is visible to the exterior of the shoe when the module is plugged in. Desirably, the LED 54 is selectably connectable via electrical contacts and circuit elements 58, 60 to a battery 62 disposed within the inwardly-projecting rectangular portion 52 of the plug-in module 32, as shown in FIGS. 4 and 5.

The plug-in module 32, or alternatively, the receptacle means 30, the sole 22 or the midsole portion 23 may further incorporate a raised, or depressed portion 70, respectively, that is intended to engage and activate a simple pressure-sensitive switch 72 disposed on the top of the plug-in module 32 for completing the electrical connection of the battery 62 with the LED 54, as described in more detail below.

Figure 6:
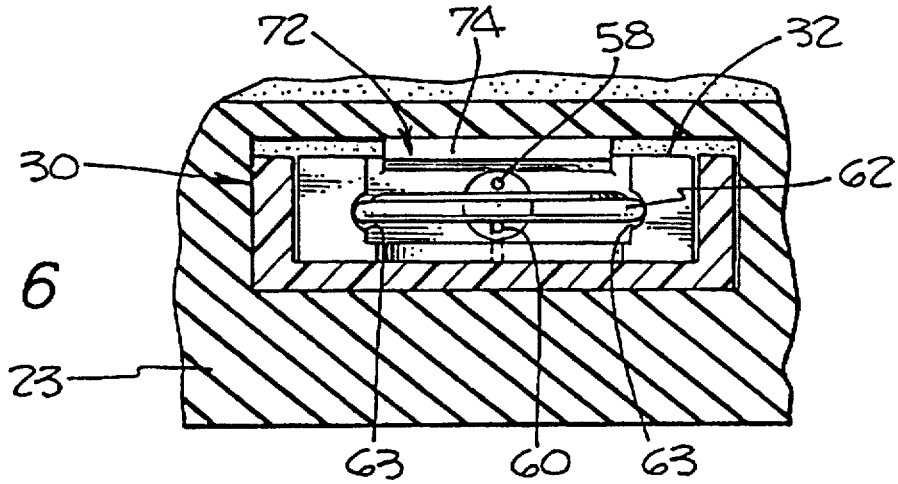
FIG. 6 is a cross-sectional view of the plug-in module.

FIG. 6 illustrates the electrical elements of the plug-in module 32 in more detail. More particularly, it will be seen that the battery 62, which may be a relatively small, disk-shaped, 3-volt lithium battery, may be positioned and retained by its edges in the body 46 of the module 32 in the orientation shown, i.e., with its oppositely-charged electrical terminals facing upwardly and downwardly, respectively, by means of a pair of spaced, opposing slots 63 formed into the interior side walls of the module body 46, into which the battery is snapped or slid. The circuit elements 58 and 60 may consist of nothing more than the stock wire leads with which the LED 54 is typically furnished at the factory. In the embodiment illustrated, these are brought through the aperture 55 into the interior of the body 46 to straddle the battery 62 in the manner shown.

As will be appreciated, for a simple LED-battery circuit, all that is required to complete the circuit is to bring appropriate ones of the LED leads 58, 60 into simultaneous contact with respective ones of the terminals of the battery 62, which, in the exemplary embodiment illustrated, is accomplished without need for any soldering or elaborate electromechanical contacts as follows: The lower one 60 of the LED leads is brought forward along the upper surface of the floor, or bottom wall, of the body 46 of the module 32 until it underlies the battery 62. The lead 60 may be fixed in this position by bending its free end downwardly, feeding it through a small aperture 64 in the floor of the body 46, then nipping it off flush with the underside of the body, but this latter refinement is not necessary to the desired result: The LED lead 60 is sized, and the position of the battery 62 is controlled such that, when the battery is snapped or slid into place in the module, its lower surface, comprising one of its electrical terminals, is maintained in constant electrical contact with the lead 60.

A similar arrangement may be adopted with the upper lead 58 of the LED, except that, here, it is brought forward along the lower surface of a cantilevered arm 74 extending forwardly from the upper surface of the body 46 of the module 32 to overlay the battery 62 and its second, upwardly-facing electrical terminal (see FIG. 3). If desired, the lead 58 may be fixed in a manner similar to that described above by bending its loose end upwardly and feeding it through a small aperture 65 through the arm 74, then terminating it flush with the body 46, but again, it has been found that this is unnecessary to the resulting switching function.

Indeed, in a more elaborate version, the upper surface of the floor of the module 32 and the lower surface of the arm 74, respectively, may each be provided with an electrical contact to which respective ones of the LED leads are soldered or crimped, the contacts being disposed appropriately with respect to the battery to contact respective ones of the battery's terminals under the appropriate conditions. However, as indicated above, these additional components and connections can result in an increased cost for the module without an attendant gain in reliability of function.

The position of the arm 74 can be adjusted such that, in one configuration, each of the leads 58, 60 of the LED are in simultaneous electrical contact with respective ones of the battery terminals whenever the battery is slid or snapped into place in the module 32. In this configuration, the LED is continuously "ON" whenever the battery 62 is installed in the module 32, regardless of whether the module 32 is plugged into the receptacle means 30 or not.

Alternatively, and more preferably, the position of the cantilevered arm 74 can be adjusted such that the upper lead 58 is spaced slightly apart from the upper terminal of the battery 62. In this embodiment, the circuit is "open", and the LED "OFF", until the arm 74 is forced downwardly such that the upper lead 58 makes forceful contact with the upper terminal of the battery, thereby completing the circuit and switching the LED "ON". In one embodiment, this may be accomplished by simply plugging the module 32 into the receptacle means 30, provided that the arm 74 is positioned appropriately relative to the upper, interior surface of the receptacle means 30 so that the former is forced downwardly by the latter when the module 32 is plugged into the receptacle means 30. In this embodiment, the LED is switched "ON" whenever the module 32 is plugged into the shoe 20, and "OFF" when the module is withdrawn.

Figure 7:
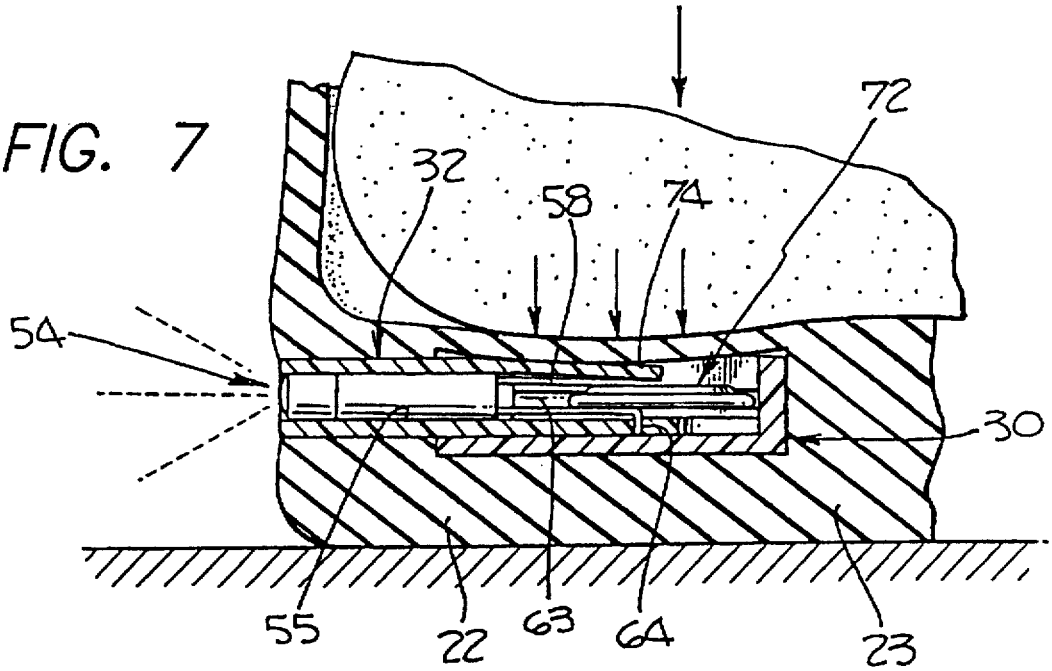
FIG. 7 is a cross-sectional view, similar to FIG. 4, of a plug-in module including a pressure-actuated switch.

In yet another embodiment, as illustrated in FIG. 7, the arm 74 can be disposed, relative to the upper, interior surface of the receptacle means 30, to require the wearer of the athletic shoe 20 to exert an additional, downward force or pressure on the arm 74, through the agency of a layer of the midsole 23 overlying it, such as that exerted on it by the heel of the wearer's foot during walking or running, in order to perfect the electrical contact of the lead 58 and energize the LED 54. Thus, it will be seen that, in this arrangement, the arm 74 functions as a simple, inexpensive, but effective means for implementing the pressure-sensitive switch 72 discussed above, and the athletic shoe 20 may thereby be equipped with a pressure sensitive light emitting device.

Figure 8:
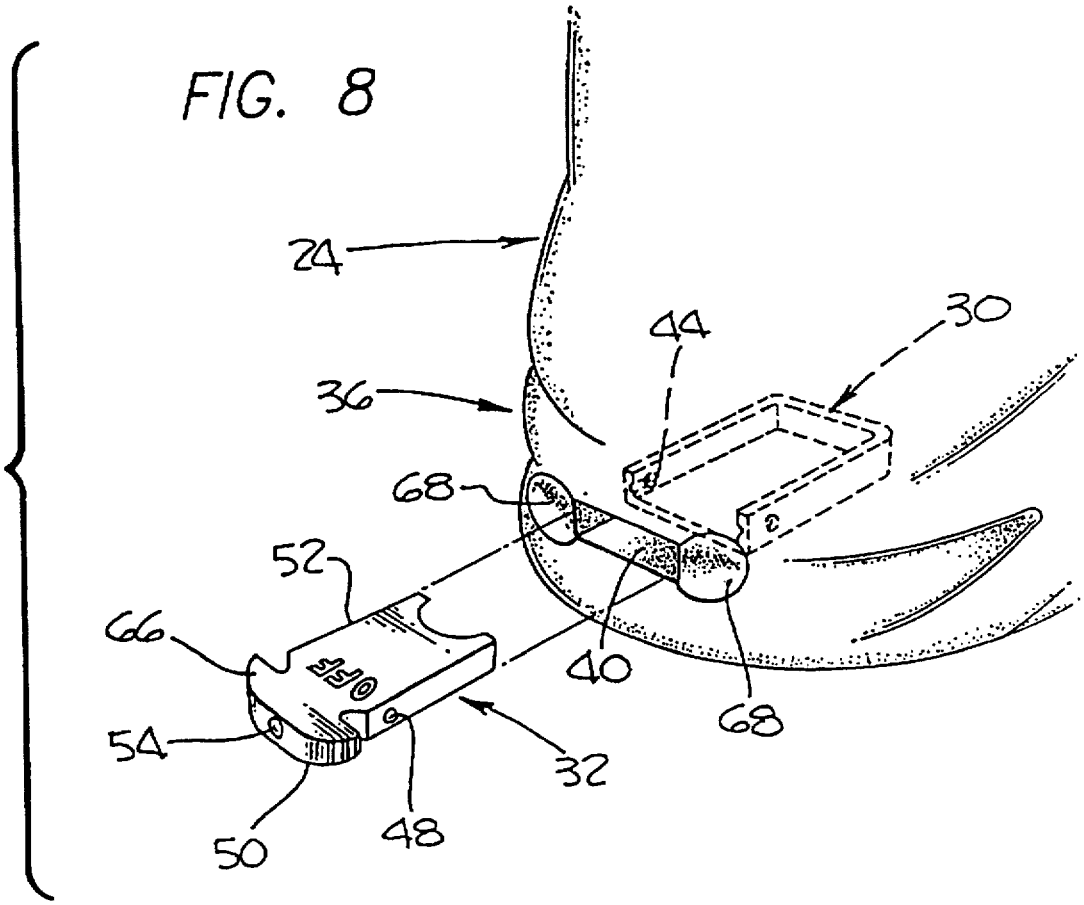
FIG. 8 is an alternative view of the plug-in light module removed from the heel portion of the shoe of FIG. 1.

FIG. 8 illustrates an exploded view of the receptacle means 30 and plug-in module 32 of FIG. 1. The plug-in module 32 is preferably configured to be insertable into the receptacle means 30 in either a right-side-up orientation, as seen in FIG. 2, or an inverted orientation, as shown in FIG. 8. By this arrangement, the position of switch 72 or arm 74, or alternatively, the upper and lower internal surfaces of the receptacle means 30, can be configured, relative to each other, such that the module is in the always-"ON" mode, or alternatively, in the mode that is "ON" in response to foot pressure, both described above, whenever the plug-in module 32 is inserted in the receptacle means 30 in the right-side-up orientation, and always "OFF" otherwise.

This embodiment permits the plug-in module 32 to be removed from the shoe 20 by the user, turned over, and re-inserted into the receptacle means 30 without the LED 54 being energized, or alternatively, without the switch 72 being operationally responsive to foot pressure to switch the LED "ON", even when the module 32 is plugged in and pressure is being exerted on the module by the wearer's foot. Thus, when the wearer of the athletic shoe does not wish to have the light "ON", or alternatively, "ON"-responsive to foot pressure, he or she may simply remove the plug-in module 32 and reinsert it back into the receptacle means 30 in the inverted position. This permits the module 32 to be lockingly retained in the shoe 20, but in the always-"OFF" mode, and thereby prevents the likelihood that the plug-in module 32 might become separated from the shoe and lost.

For an athletic shoe, it is important to appreciate that the midsole portion 23 of the sole 22 frequently is formed from a molded piece of foamed elastomeric material, such as ethylene vinyl acetate ("EVA") or polyurethane ("PU"), whereas, the outsole 24 is typically a harder, non-foamed elastic material, such as synthetic rubber. These structures, acting in cooperation with each other and the remaining elements of the shoe, are required to provide resilient support of all of the structural elements of the foot, and in particular, the heel bones and the bones of the balls and toes of the foot, which take the brunt of impact shock during any particular athletic activity that involves running or jumping. Indeed, the sole 22 is required to absorb and recoil from impact and shock, yet be sufficiently flexible to allow the flexure and return required by the heel-to-toe progression that occurs during walking or running, and also to absorb lateral forces resulting from the various types of rotational motion that may be imparted by the wearer during various other kinds of athletic activities.

Accordingly, it will be understood that the resilient support nature of the sole 22, particularly the midsole portion 23 of the athletic shoe 20, must adhere to particular design constraints, even though it may also be desirable to incorporate within it a plug-in module arrangement of the type described herein.

In the cross sectional view of FIG. 4, the receptacle means 30 are illustrated as being spaced between top and bottom layers of the midsole portion 23 of the sole 22. More particularly, for a midsole 23 having a base thickness $D_1$, and wherein the thickness of the receptacle means is $T_1$, the thickness of the resilient portion of the midsole 23 above the receptacle means 30 will be $D_2$, and the thickness of the resilient midsole element below the receptacle means 30 will be $D_3$. It has been discovered that, for a midsole having typical hardness characteristics and a thickness of $D_1$ in the range of between 15 and 22 millimeters, the ratio of $D_2$ to $D_1$ will preferably be in the range of between about 0.09 and 0.2 to achieve successful incorporation of a plug-in module of the general type described herein within the midsole, yet retain the desired athletic shoe sole shock and flexibility characteristics. Further, the preferred ratio of $D_3$ to $D_1$ will be in the range of between about 0.2 and 0.5, and the ratio of the thickness $T_1$ of the receptacle means to the thickness of the sole $D_1$ will preferably be in the range of between about 0.45 and 0.8.

FIG. 5 illustrates a cross-sectional view taken along line 5—5 of FIG. 4. In FIG. 5, the outer portion of the receptacle means 30 is illustrated, as is the cross-section through the plug-in module 32 depicting the LED 54 in the center thereof. In addition, the relative thickness of the material of the midsole in the space above the plug-in module 32 is again illustrated. For purposes of maintaining the proper distance, this thickness of the midsole should preferably be in the range of 2 to 5 millimeters for elastomeric materials having a hardness of about 55 to 60 Shore-C.

Figure 9:
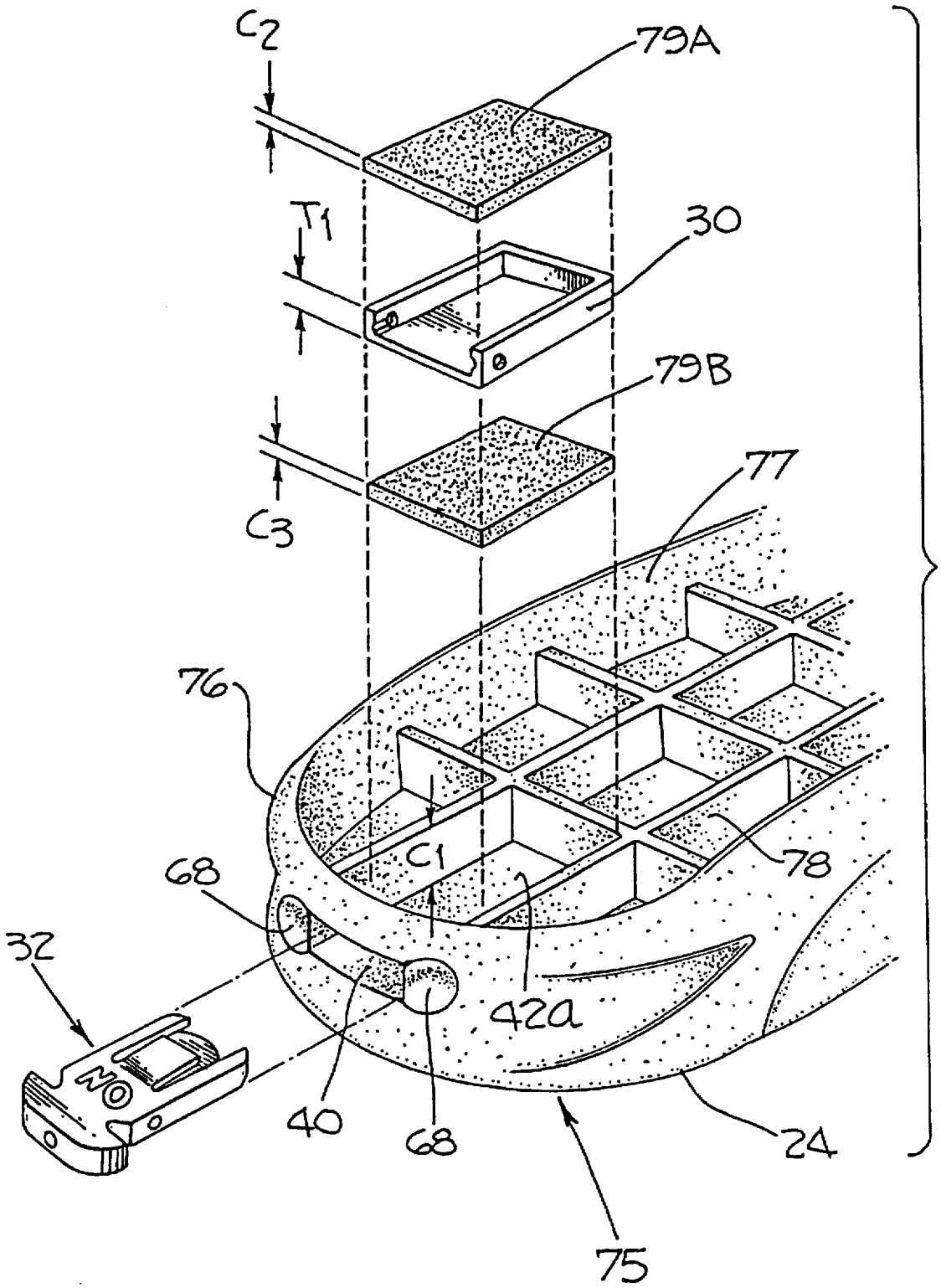
FIG. 9 is an exploded partial view of an athletic shoe having a different form of sole construction than that illustrated in FIG. 2, and which also incorporates the plug-in module of this invention.

However, it should not be presumed from the preceding discussion that the plug-in module 32 of the present invention is necessarily limited to athletic shoes having separate, layered midsoles and outsoles of solid or foamed resilient materials, as described above. FIG. 9 illustrates an alternative form of sole construction for an athletic shoe that is frequently referred to as a "cupsole unit bottom" 75. Here, the outsole element 24 of the shoe is typically molded of a resilient rubber material to include an upwardly-wrapping sidewall 76 that defines an upwardly-facing "cup" 77, into which the upper 25 of the shoe is received and fastened.

In such construction, it is possible to include a conventional midsole structure, either in a pre-molded, drop-in form, or by directly molding it therein, prior to attachment of the upper. Alternatively, and usually as a cost- and/or weight-saving feature, the midsole may be omitted altogether in preference to the "bridgework" type of structure illustrated, comprising a plurality of upstanding, interconnected walls 78 that are integrally molded into the cupsole structure, and which define between them a plurality of open-topped, unconnected, hollow cavities. These cavities are subsequently "closed" when the upper is bonded into the cup, which typically involves the placement and bonding of a "lasting board", incorporated into the bottom of the upper, onto the upper surface of the cavities.

As will be seen, this alternative form of sole construction can easily accomodate the plug-in module 32 of the present invention, provided certain provisions are made to accomodate it. Thus, in the bridgework-type of cupsole construction illustrated in FIG. 9, a cavity 42A that conforms to the outer length and width dimensions of the receptacle means 30 is formed into the cupsole 75 at the time of its initial molding. The upstanding sidewall 76 includes an opening 40 extending through it and into the cavity 42A, similar to that found in the midsole-equipped shoe of FIG. 2.

The height $C_1$ of the cavity 42A, however, exceeds the thickness $T_1$ of the receptacle means 30, and is typically on the order of about 12–18 millimeters (mm). Accordingly, to accomodate this difference in dimensions, and to ensure functional equivalency with the resilient midsole-equipped shoe having a plug-in module of the type discussed above, top and bottom die-cut, resiliant foam inserts 79A and 79B having a hardness in the range discussed above in connection with foamed midsole materials are disposed above and below the receptacle means 30, respectively, within the cavity 42A to form a layered sandwich therein. The layers of the sandwich are then adhesively bonded to each other and to the sidewalls and floor of the cavity to hold the receptacle means 30 in place.

To arrive at the appropriate thicknesses $C_2$ and $C_3$ of the top and bottom inserts 79A and 79B, respectively, it is necessary first to subtract the thickness $T_1$ of the receptacle means 30 from the height $C_1$ of the cavity 42A. The difference is then preferably apportioned between $C_2$ and $C_3$ in the ratio of 60% to 40%. Thus, in a preferred embodiment, and where the cavity height $C_1$ is about 12–18 mm, the thickness $C_2$ of the top insert 79A will be about 2–4 mm, and the thickness $C_3$ of the bottom insert 79B will measure about 1–3 mm, all other things remaining the same. Likewise, the ratio of $C_2$ to $C_1$ will preferably be in the range of about 0.11–0.33, and the ratio of $C_3$ to $C_1$ will be about 0.05–0.25.

Our tests have shown that, provided these guidelines are adhered to, there is essentially no difference in plug-in module implementation and performance between shoes equipped with solid, layered midsoles, such as that illustrated in FIG. 2, and those equipped with open-bridgework cupsoles, as illustrated in FIG. 9. Indeed, the plug-in modules are completely interchangeable between the two in terms of form, fit and function.

The components of the receptacle means 30, as well as the plug-in module 32, are preferably formed from an inexpensive, yet durable plastic material, such as an acetyl resin for colored parts, or a polycarbonate for clear parts. These materials provide adequate rigidity and durability, yet are sufficiently resilient to permit the spring-like flexure of, for example, the complementary locking engagement means 44, 48 and the cantilevered switch arm 74 features discussed above, and also conform well to the rigors of the intended environment.

Figure 10:
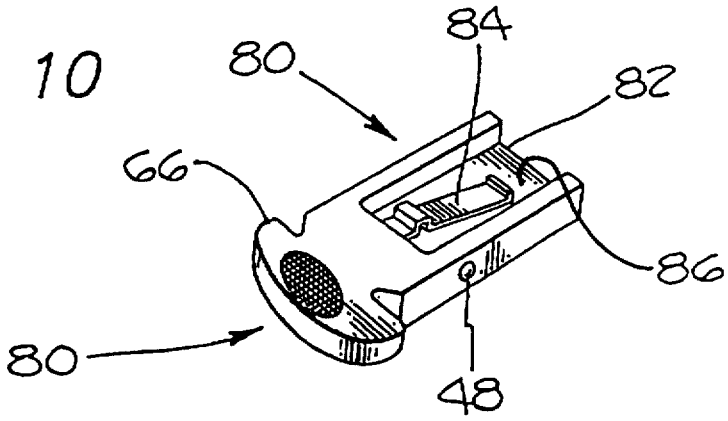
FIG. 10 is a perspective view of an alternative plug-in module that includes a storage compartment with retention clip.

FIG. 10 depicts an alternative embodiment of a plug-in module 80 having a different function than that described above. The module 80 is generally sized the same as the plug-in module 32 of FIGS. 1–7; however, in this embodiment, the circuit elements, such as a battery or an LED, are omitted. Instead, the module 80 is adapted to provide a small, personal storage compartment 82 having an open top, and optionally, a retaining clip 84 in its internal recess 86. The compartment 82 is closed when the module is plugged into the shoe 20, and by this arrangement, as opposed to the lighting function of the plug-in module 32, functions as a small, portable, enclosed storage compartment for take-along storage of small personal articles of the wearer, such as money, or a locker or house key.

Figure 11:
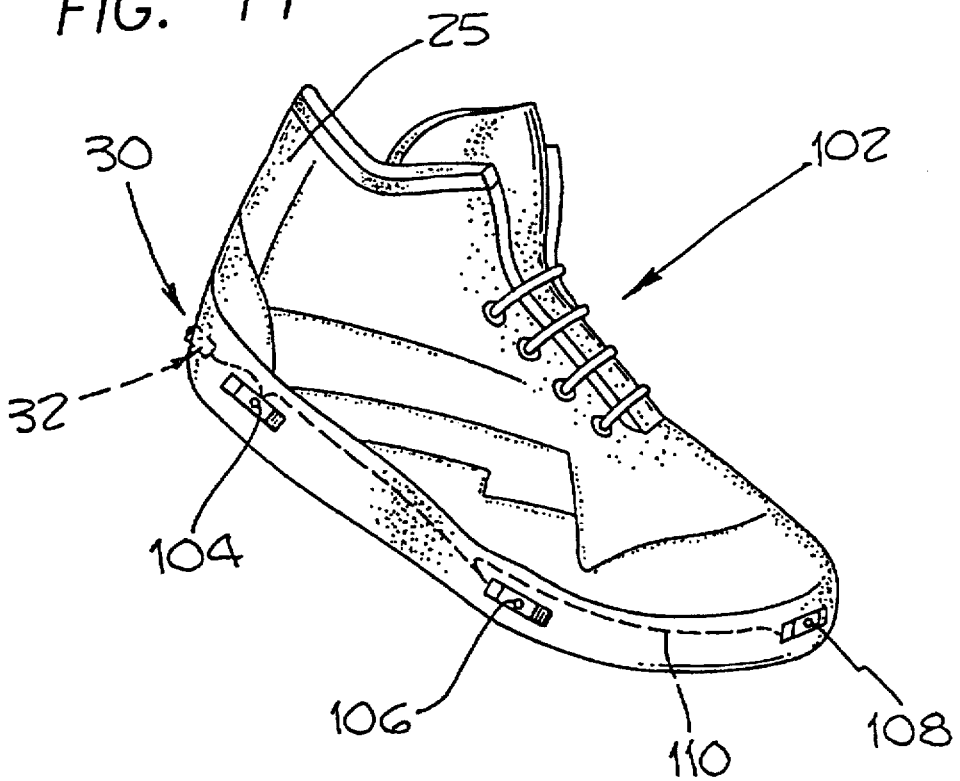
FIG. 11 is an alternative embodiment of the athletic shoe of the present invention.

FIG. 11 depicts an alternative configuration of the present invention, in which an athletic shoe 102 includes the receptacle means 30 and plug-in module 32 generally equivalent to that seen in FIGS. 1–7, and additionally, a plurality of LED's 104, 106, 108 spaced about and incorporated into the sole 22 of the shoe. The plurality of LEDs are connected via electrical conductors 110 to a point proximate the electrical conductors or circuit elements 58, 60 of the plug-in module 32 by, for example, simple contacts on the top and bottom or on the sides of the plug-in module. By this configuration, the benefits of being able quickly to remove and replace the battery in the plug-in module, and the attendant design advantages thereof, can be utilized for powering a number of LEDs spaced remotely about the shoe 102. Further, if desired, the LEDs could be spaced at various locations other than in the sole 22 of the shoe 102 and interconnected via electrical conductors to the plug-in module 32.

Indeed, the skilled practitioner will by now recognize that many variations and modifications of the plug-in module for an athletic shoe described herein are possible in terms of function, materials, configuration, and mode of operation, depending on the particular problem at hand. Accordingly, the embodiments described herein should be taken as exemplary in nature only, and the scope of the present invention limited only by the proper interpretation of the claims appended hereafter.

What is claimed is:

1. A plug-in module adapted to be slidably received and releasably locked into a receptacle, said module comprising:

a battery;

a housing including a pair of opposingly arranged battery supports for supporting said battery;

light emitting means contained within said housing for emitting visible light when energized by said battery;

electrical circuit means for electrically interconnecting said battery and said light emitting means;

switch means for selectably closing said electrical circuit means in response to a pressure exerted on said switch means, wherein said switch means includes a protruding member operatively connected with said electrical circuit means, which extends in a cantilevered fashion over a first side of said battery when said battery is supported by said battery supports, said protruding member being responsive to applied pressure to contact said battery, thereby causing an electrical connection between said battery and said light emitting means; and means, responsive to a predetermined orientation of said module in said receptacle, for disabling said switch means, thereby preventing illumination of said light emitting means.

2. The module of claim 1, wherein said housing further comprises:

a rectangular portion defining a chamber.

3. The module of claim 1, wherein said housing is formed from at least one of an acetyl resin and a polycarbonate.

4. The module of claim 1, further comprising:

complementary engaging means formed on an exterior of said housing and on an interior of said receptacle for releasably locking said module in said receptacle.

5. The module of claim 1, wherein said battery supports are spaced a predetermined distance apart so as to releasably secure said battery in said housing by engaging side surfaces of said battery.

6. The module of claim 5, wherein said housing has formed therein a chamber, disposed adjacent an exterior side wall of said housing, for containing said light emitting means.

7. The module of claim 6, wherein said electrical circuit means comprises a first electrical lead, disposed within said housing so as to provide an electrical connection between said battery and said light emitting means, and wherein said protruding member comprises a second electrical lead connected to said light emitting means.

8. A plug-in module adapted to be slidably received and releasably locked into a receptacle, said module comprising:

a battery;

a housing including a pair of opposingly arranged battery supports for supporting said battery, wherein said battery supports are spaced a predetermined distance apart so as to releasably secure said battery in said housing by engaging side surfaces of said battery;

light emitting means contained within said housing for emitting visible light when energized by said battery, wherein said housing has formed therein a chamber, disposed adjacent an exterior side wall of said housing, for containing said light emitting means;

electrical circuit means for electrically interconnecting said battery and said light emitting means, wherein said electrical circuit means comprises a pair of electrical leads, disposed within said housing so as to provide an electrical connection between said battery and said light emitting means switch means, connected with at least one of said pair of electrical leads and operatively responsive to pressure applied thereto, for electrically connecting said at least one of said pair of electrical leads to said battery, thereby causing said light emitting means to illuminate, wherein said receptacle includes means for slidably receiving and removably securing said module therein, said receptacle including a hollow, generally rectangular interior and means, responsive to a predetermined orientation of said module, for disabling said switch means, thereby preventing illumination of said light emitting means.

9. An illuminating apparatus including a module powered by a battery and adapted to be slidably received and releasably locked in a receptacle, said module comprising:

a housing having a plurality of walls defining a chamber therein, said walls including a pair of substantially parallel, opposingly arranged sidewalls spaced a predetermined distance apart, each of said sidewalls including a slot formed therein, said slots slidably receiving and releasably securing said battery therebetween;

light emitting means contained within said chamber for emitting visible light when energized by said battery;

electrical circuit means for electrically interconnecting said battery and said light emitting means;

a switch, connected to said electrical circuit means and said battery, for selectably completing an electrical connection between said battery and said light emitting means, wherein said light emitting means emits visible light in response to the completing of said electrical connection, and for selectably breaking an electrical connection between said battery and said light emitting means, wherein said light emitting means ceases emitting visible light in response to the breaking of said electrical connection.

10. The apparatus of claim 9, wherein said electrical circuit means comprises a pair of electrical leads for providing an electrical connection between said battery and said light emitting means.

11. An illuminating apparatus including a module powered by a battery and adapted to be slidably receiving and releasably locked in a receptacle, said module comprising:

a housing having a plurality of walls defining a chamber therein;

a pair of opposingly arranged battery supports connected with said housing and spaced a predetermined distance apart so as to releasably secure said battery therebetween;

light emitting means contained within said chamber for emitting visible light when energized by said battery;

electrical circuit means for electrically interconnecting said battery and said light emitting means, wherein said electrical circuit means comprises a pair of electrical leads for providing an electrical connection between said battery and said light emitting means;

a switch, connected to said electrical circuit means and said battery, for selectably completing an electrical connection between said battery and said light emitting means, wherein said light emitting means emits visible light in response to the completing of said electrical connection, and for selectably breaking an electrical connection between said battery and said light emitting means, wherein said light emitting means ceases emitting visible light in response to the breaking of said electrical connection, wherein said receptacle includes securing means for slidably receiving and removably securing said module therein, said receptacle including a hollow, generally rectangular interior, and means, responsive to a predetermined orientation of said module in said receptacle, for disabling said switch, thereby preventing illumination of said light emitting means.

12. The apparatus of claim 11, wherein said receptacle is comprised of plastic.

13. The apparatus of claim 11, wherein said receptacle is comprised of a polycarbonate material.

14. The apparatus of claim 11, wherein said switch is physically connected with said housing and comprises a protruding member which extends from said housing in a cantilevered fashion over a first side of said battery when said battery is supported by said battery supports, said protruding member being responsive to applied pressure to cause at least one of said pair of electrical leads to contact said battery, thereby completing an electrical connection between said battery and said light emitting means.

15. The apparatus of claim 14, wherein said disabling means comprises a switch disabling member, operatively associated with said pair of battery supports and responsive to a predetermined orientation of said module in said receptacle, for preventing pressure from being applied to said protruding member.

16. The apparatus of claim 15, wherein said switch disabling member comprises a rigid, substantially inflexible member connected between said pair of battery supports on a second side of said battery opposite from said first side of said battery.

17. The apparatus of claim 11, wherein said receptacle includes an opening for slidably receiving said module.

18. An illuminating apparatus including a module powered by a battery and adapted to be slidably received and releasably locked in a receptacle, said module comprising:

a housing having a plurality of walls defining a chamber therein;

a pair of substantially parallel, opposingly arranged battery supports connected with said housing and spaced a predetermined distance apart, said battery supports each including a slot formed therein to slidably receive and releasably secure said battery therebetween;

light emitting means contained within said chamber for emitting visible light when energized by said battery;

electrical circuit means for electrically interconnecting said battery and said light emitting means;

a switch, connected to said electrical circuit means and said battery, for selectably completing an electrical connection between said battery and said light emitting means, wherein said light emitting means emits visible light in response to the completing of said electrical connection, and for selectably breaking an electrical connection between said battery and said light emitting means, wherein said light emitting means ceases emitting visible light in response to the breaking of said electrical connection, wherein said switch is physically connected with said housing and comprises a protruding member which extends from said housing in a cantilevered fashion over said battery when said battery is supported by said battery supports.

19. The module of claim 18, wherein said electrical circuit means comprises first and second electric wires, said first electric wire being disposed in continuous contact with said battery and said light emitting means when said battery is supported by said battery supports, said second electric wire being connected to, and movable with, said protruding member and connected with light emitting means.

* * * * *